US006397745B2

(12) United States Patent
Koehler

(10) Patent No.: US 6,397,745 B2
(45) **Date of Patent: *Jun. 4, 2002**

(54) METHOD AND APPARATUS FOR MAINTAINING INK LEVEL IN INK FOUNTAIN OF PRINTING PRESS

(75) Inventor: James E. Koehler, Bright (CA)

(73) Assignee: Accel Graphic Systems, Inc., Dallas, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/225,429

(22) Filed: Jan. 5, 1999

Related U.S. Application Data

(60) Division of application No. 08/891,587, filed on Jun. 20, 1997, now abandoned, which is a continuation-in-part of application No. 08/723,693, filed on Sep. 30, 1996, now abandoned.

(51) Int. Cl.[7] ..... B41F 31/02

(52) U.S. Cl. ..... 101/366; 347/7; 137/392; 250/231.19

(58) Field of Search ..... 101/348–351, 101/147, 148, 423, 425, 363–367, 207–210, 484, 350.1; 118/24, 25, 259, 688, 683–685, 710, 429; 73/290 V; 367/908; 364/509; 222/71, 23, 41, 278, 386; 141/95, 198; 340/621; 346/140 R, 1.1, 75; 137/527, 527.6, 527.8, 535–537; 250/231.19

(56) References Cited

U.S. PATENT DOCUMENTS 3,145,567 A 8/1964 Bobrowsky
3,199,451 A 8/1965 Nitchie
3,292,534 A 12/1966 Maschinot
3,354,823 A 11/1967 Lake
3,590,736 A 7/1971 Malek
3,667,500 A 6/1972 Stone
3,710,714 A 1/1973 Graupner
3,730,089 A 5/1973 McCutcheon
3,780,651 A 12/1973 Black, et al.
3,788,220 A 1/1974 Laben et al.
3,848,529 A * 11/1974 Gegenheimer et al. ..... 101/363
3,885,496 A 5/1975 Breitweg et al.
4,010,683 A 3/1977 Lambert et al.
4,043,265 A 8/1977 Grobman
4,088,074 A 5/1978 Dahlgren et al.
4,092,922 A 6/1978 Schweitzer
4,099,461 A 7/1978 Mitter
4,108,068 A 8/1978 Lambert et al.
4,116,128 A 9/1978 Lehmann et al.

(List continued on next page.)

OTHER PUBLICATIONS

Sick Optic–Electronic, Inc. "Sensick Opto–Optic–Electronic Sensors Parts Catalog", Erwin Sick GmbH Optic–Elektronic, title page, copyright page, pp. 29–30 and 129, (1995).

Sick Optic–Electronic, Inc., "Photoelectric Proximity Sensor for Small Parts Detection WT 4 Product Sheet", Erwin Sick GmbH Optik–Elektronic, pp. 1–2, (1995).

*Primary Examiner*—Eugene Eickholt
(74) *Attorney, Agent, or Firm*—Munsch Hardt Kopf & Harr, P.C.; Marc A. Hubbard

(57) ABSTRACT

An ink management system for an offset printing press includes a cartridge of offset printing press ink, wherein the cartridge has an exit opening in one end through which ink is dispensed and an open end opposite said exit opening. A movable member is disposed within said ink cartridge for dispensing ink from said ink cartridge. Movement of the movable member dispenses ink into an ink fountain through the exit opening. The displacement of the movable member is determined in order to track an amount of ink dispensed during, for example, a printing run.

22 Claims, 11 Drawing Sheets

U.S. PATENT DOCUMENTS 4,130,126 A 12/1978 Chocholaty et al.
4,287,828 A 9/1981 Dahlgren
4,290,362 A 9/1981 Kobler et al.
4,342,042 A * 7/1982 Cruz-Uribe et al. ..... 347/7
4,358,996 A 11/1982 Ohlsson
4,378,735 A 4/1983 MacPhee
4,384,523 A 5/1983 Ryan
4,392,426 A 7/1983 Wege
4,401,031 A 8/1983 Buan
4,422,084 A 12/1983 Saito
4,453,467 A 6/1984 Jeschke
4,461,210 A 7/1984 MacPhee et al.
4,479,433 A 10/1984 MacPhee et al.
4,481,883 A 11/1984 Savart et al.
4,535,693 A * 8/1985 Belvederi ..... 101/366
4,542,652 A * 9/1985 Reuter et al. ..... 73/597
4,543,649 A * 9/1985 Head et al. ..... 367/96
4,604,633 A * 8/1986 Kimura et al. ..... 347/7
4,709,633 A * 12/1987 Woestman ..... 101/163
4,764,671 A 8/1988 Park
4,781,066 A * 11/1988 Pope et al. ..... 73/239
4,787,313 A * 11/1988 Osborn et al. ..... 101/366
4,852,604 A * 8/1989 Wales et al. ..... 137/392
4,926,693 A * 5/1990 Holm-Kennedy et al. .... 73/597
4,930,416 A 6/1990 Kawabata et al.
4,938,054 A * 7/1990 Dye et al. ..... 73/3
4,977,413 A * 12/1990 Yamanaka et al. ..... 347/7
4,978,042 A * 12/1990 Fidler ..... 222/642
5,076,767 A 12/1991 Desaulniers et al.
5,103,728 A * 4/1992 Barney ..... 101/364
5,136,309 A * 8/1992 Iida et al. ..... 247/7
5,267,793 A 12/1993 Hawitt
5,280,750 A 1/1994 Yoshida et al.
5,299,290 A 3/1994 Ostermeier
5,357,864 A 10/1994 Ohta et al.
5,398,847 A * 3/1995 Hasegawa ..... 222/41
5,410,960 A 5/1995 Adsett
5,427,136 A 6/1995 Weishew
5,454,314 A 10/1995 Fischer
5,479,193 A * 12/1995 Shimmioda et al. ..... 347/7
5,724,890 A 3/1998 Deschner et al.
5,799,578 A * 9/1998 Junghans ..... 101/348
5,878,667 A * 3/1999 Ryan ..... 101/366
5,890,431 A * 4/1999 Schafer ..... 101/335
5,977,778 A * 11/1999 Chan et al. ..... 324/635

* cited by examiner

METHOD AND APPARATUS FOR MAINTAINING INK LEVEL IN INK FOUNTAIN OF PRINTING PRESS

CROSS REFERENCE TO RELATED APPLICATIONS

This application is a divisional of U.S. Application Ser. No. 08/891,587, filed Jun. 20, 1997 now abandoned, which is a continuation-in-part of U.S. Application Ser. No. 08/723 693, filed Sep. 30, 1996 now abandoned, which application is incorporated herein for all purposes by reference.

FIELD OF THE INVENTION

The invention pertains generally to the field of printing presses and, more particularly, to ink fountains for printing presses.

BACKGROUND OF INVENTION

In rotary offset printing presses, a thin film of ink is continuously applied to a printing plate on which has been formed an ink receptive image. The thin film of ink tends to adhere only to the image portion of the plate. The plate is carried on a rotating cylinder or drum. The printing plate rolls the image directly on a printing substrate (e.g. paper or mylar) or on an impression blanket cylinder, which in turn rolls it onto paper. Paper is fed along a transport in either discrete sheets or a continuous web.

The ink film applied to the printing plate must be of uniform thickness and continuous for printing an image of consistent quality on the paper. To create and deliver this thin film of ink, a train of rollers takes ink from a reservoir called an ink fountain and, during transport of ink from one roller to the next, smooths it into the continuous and uniform thin film. The ink is metered from the fountain to the ink train at a rate which is sufficient to maintain uniformity and continuity in the film. Most ink is metered from fountains using a similar method. An end of a substantially flat plate, called a blade, is placed under and to one side of a rotating roller, called a fountain roller. The blade is angled upwardly to trap the ink against the fountain roller. Cheeks on opposite sides of the blade and roller create, with the blade and the fountain roller, the ink reservoir. The blade is positioned so that, as it engages the fountain roller, a narrow gap is formed between it and the roller. The fountain roller rotates toward the blade, taking with it a film of ink adhering to its surface. The size of the gap between the roller and the blade determines the amount or thickness of the film which is carried by the fountain roller and delivered to the ink train via, typically, a ducting roller. The position of the edge of the blade with respect to the fountain roller is adjustable to change the metering rate. As consumption rates usually varies across the fountain due variations in the image being printed, the metering edge of most blades is flexible so that ink can be metered at different rates along its width. A row of screws or adjustable pins, called keys, are used to slightly bend or pressure the edge at discrete locations and thereby contour the edge of the blade and vary the gap or pressure between the blade and fountain roller. Each key can be used to adjust metering along a predefined interval or segment of the blade.

Printing ink is a oily, viscous substance. It is tacky so that it will properly adhere to the image areas on the printing plate. For example, ink used to print newspapers is the least viscous, usually in the range of 50 to 80 poise. Ink for letter presses and heat-set inks employed for web offset printing have viscosities in the range of about 150 to 200 poise. Inks for sheet fed, lithographic offset printing presses are the most viscous, usually in the range of 250 to 300 poise. Newer "waterless" inks, which eliminate the need for conventional dampening systems to apply a thin film of water to the non-image areas of the printing plate, are highly viscous, gel-like substances which do not flow. Due to printing inks viscous nature and tendency to stick to surfaces in the ink fountain, the ink will tend not to flow easily to low spots, especially when the level of the ink in the fountain is low or the printing ink is of the very viscous type used in sheet fed, lithographic offset presses. The ink level in the fountain can develop low spots, especially as the overall level of ink in the fountain drops. A low spot will lead to a tinning of the supply of film to the ink train, which in turn may result in a film which is not uniform or is discontinuous being delivered to the printing plate, resulting in poor quality prints.

In smaller and mid-size offset presses, especially sheet fed offset presses, a pressman manually scoops ink out of a can and spreads it along the width of the ink fountain in a thick layer at the commencement of a run. Pressmen will naturally tend to put more than enough ink in the fountain for the job to guard against development of low spots which could result in wasted prints of inferior quality. Consequently, it is not unusual for a substantial amount of ink leftover in the ink fountain at the end of a run. This ink is almost always discarded. It may be specially mixed for the particular job and it tends to quickly oxidize. A portion of ink in the fountain is exposed to air and will have already begun to oxidize, even if agitated or stirred in the ink fountain to reduce the effects of oxidation.

By some estimates, as much as seventy percent (70%) of ink used in printing is discarded. Discarded ink imposes a substantial cost on printing in two ways. First, printing ink is expensive and constitutes a large portion of the total cost of a printing job. Second, printing ink is a hazardous substance and is environmentally harmful. Disposal of discarded ink in an environmentally sensitive way is expensive and, in many places, mandated by government regulations.

Automatic systems have been used for replenishing ink in ink fountains on large printing presses, especially newspaper and other large web printing presses which consume large quantities of lower viscosity ink. These systems operate to maintain a predetermined quantity of ink in the system by measuring the level of the ink in the ink fountain and opening a valve to pump ink into the fountain from an external drum or supply when the ink drops below a preset level. Several techniques have been used in such apparatus to sense the level of ink, including floats, tactile or mechanical sensors, pneumatic sensors, capacitive sensors and ultrasonic sensors. Generally, sensors which require physical contact with the ink have been unreliable due, at least in part, to the viscosity of the ink. The invasiveness of such sensors may also interfere with the metering function of the fountain. Ultrasonic transducers which determine distance using conventional ranging methods are beset by a number of problems commonly associated with acoustic ranging equipment. Acoustic signals are sensitive to air disturbances which may deflect or reflect the signal. They are also sensitive to ambient temperature fluctuations which alter the velocity of the acoustic waves. Air disturbances and temperature fluctuations may be caused, for example, the heat given off by the printing press and other environmental influences. Disturbances in the surface of the ink caused by, among other things, mechanical agitators used to stir the ink also cause inaccurate readings. Acoustic signals will also tend to resonate or ring if the distance between the sensor and the surface of the ink is small, making timing of the return signal difficult and unreliable.

The objective of such systems is not to avoid discarding ink, however. In large runs, the amount left over in the ink fountain is not likely to be a large percentage of the amount of ink dispensed from a bulk supply. Rather, it is supplying large quantities of ink to reservoirs of limited capacity for large printing runs. Such automatic system will tend to maintain a maximum amount of ink in an ink fountain in order to avoid any risk of ink starvation. Such apparatus do not address the special problems of maintaining only a minimum level of ink in the ink fountains, especially when such ink is highly viscous.

SUMMARY OF THE INVENTION

The invention provides for an apparatus and method for automatically maintaining a minimum level of ink in an ink fountain and thereby avoid wastage, especially when using ink which is viscous or does not flow well. The preferred embodiment of the invention has a number of different aspects, which, singly or in combination with one or more of the other aspects, give it advantages over the prior art, especially when used on printing presses running smaller jobs and/or use using particularly viscous ink. Several of these aspects and their advantages are summarized below.

According to one aspect, an ink fountain level sensor is mounted for lateral movement across the ink fountain. It moves across the ink fountain, measuring the level of ink along the width of the fountain. When a low ink level is detected, an ink dispenser deposits additional ink into the fountain. A lower level of ink within the fountain can be set, especially when using highly viscous ink, as the sensor will be able to guard against low spots developing which would result in ink starvation.

According to another aspect, an ink dispenser is mounted for lateral movement across the ink fountain. Ink may thereby be delivered immediately and directly to low spots, if and when they develop. It effectively is delivered directly to the sections of the ink fountain consuming most of the ink. As the ink need not flow from a fixed dispense location, a lower level of ink can be maintained in the fountain and consumption demands for different portions of the fountain met. In combination with an ink fountain level sensor scanning the ink level, the dispenser may be directed to the low spot. When mounted for movement with the ink fountain level sensor, the dispenser may remedy the low level soon after detection.

Furthermore, and according to another aspect, an ink dispenser deposits ink on a fountain roller. The roller carries the ink toward, and forces it into, the narrow convergence between the fountain roller and the blade in the ink fountain. Thus, a large head of ink need not be maintained to push it toward the metering gap between the blade and fountain roller of a conventional ink fountain. Indeed, a small bead of ink may be maintained in the gap when the ink dispenser traverses the fountain and deposits small amounts of ink as needed to maintain the bead.

According to another aspect, ink level in an ink fountain is sensed using a photoelectric proximity sensor which reflects an optical beam off of surfaces. The beam may be aimed such that it determines whether there is ink between it and a certain predetermined distance and determines whether the ink level is low based on where the reflected beam hits an optical detector. The beam can be focused or aimed at a small areas. It tends not to be subject to ambient disturbances which affect ultrasonic waves. The method of measuring offers a high resolution and accuracy. When traversed across the ink fountain, it is well suited for detecting low spots in the ink, especially when the ink is maintained as a bead of narrow cross-section in the convergence between a fountain roller and a blade. It also has advantages over the prior art. For example, ultrasonic waves used in ultrasonic sensors tend to spread. Thus, they tend not to have sufficient resolution to discriminate between the ink fountain and a minimum ink level in the ink fountain, especially a small bead nestled between a blade and fountain roller. It is also difficult to use capacitive or inductive sensors in such situations since they will tend to give erroneous readings when positioned too close to metal in the ink fountain.

Finally, irregularities in the surface of ink in an ink fountain cause unpredictable deflections in an optical beam transmitted by an photoelectric proximity sensor traversing the length of the fountain. Such deflections result in false readings: sometimes the beams reflection is such that it appears that the ink level is closer than it actually is; sometimes the reflection indicates that the ink level is farther than it actually is. To better assure that the level of ink is maintained at a preset level, the ink fountain level sensor is, according to another aspect of an embodiment of the invention, sampled multiple times over a predefined segment or interval. Ink is dispensed when a predefined percentage of samples taken within the segment indicates a low ink level; or, conversely, ink is not dispensed when a predefined percentage of samples indicates that the ink is above a preset level. Although the samples can be taken over a series of fixed, end-to-end segments, the calculation is preferably done on a segment moving with the ink fountain level sensor. In effect, it is a moving window of the last number of samples constantly moving, in effect, a single segment. A running percentage is calculated by taking the value of next sample and dropping the value of last sample, and determining the percentage of samples indicating that either the ink in the fountain is low or high. This moving window avoids the possibility of a low spot developing at a boundary between otherwise fixed segments.

The forgoing summary is intended only to aid in the understanding of advantages of various aspects of the preferred embodiments exemplifying the invention and not to limit the scope of the invention as set forth by the appended claims. The invention, as claimed, may have other or additional advantages which will be apparent from the following description of the preferred embodiment made in reference to the accompanying drawings, in which:

DETAILED DESCRIPTION

Figure 1:
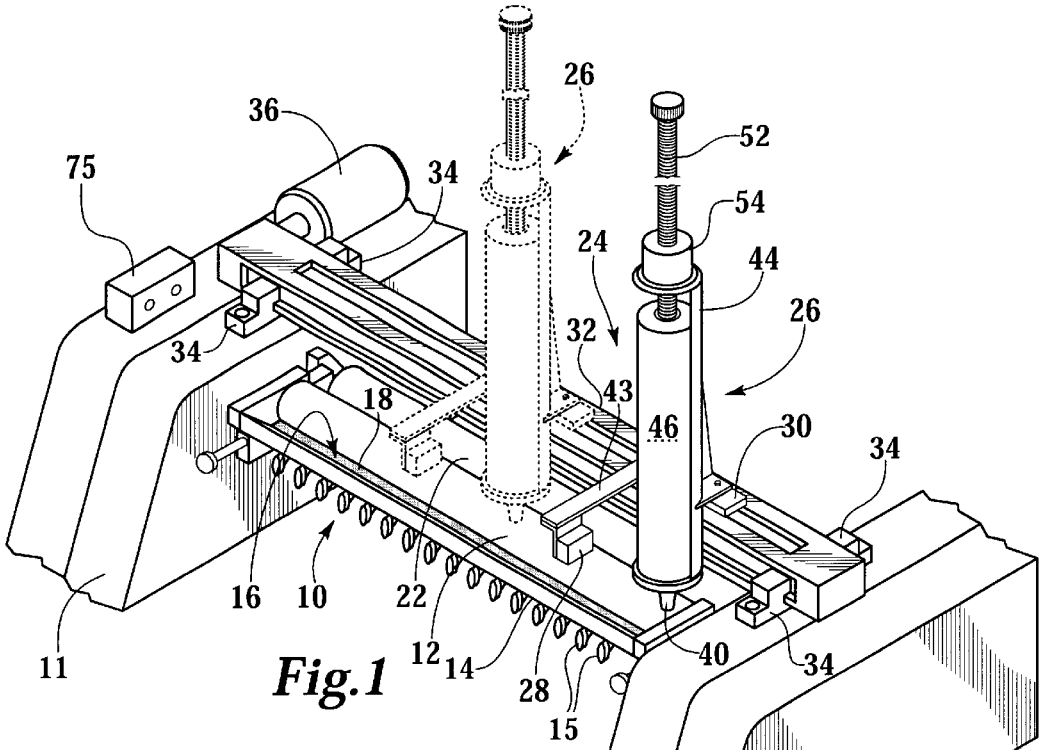
FIG. 1 is an isometric view of a representative ink fountain and portion of an ink train for a printing press with a first embodiment of an ink management system for automatically maintaining a predetermined minimum level of ink in the ink fountain.

In the following description, like numbers refer to like parts unless the context indicates otherwise.

Referring generally to FIGS. 1 through 4, an ink fountain 10 of conventional construction is supported by frame 11 of a printing press. Ink fountain 10 is intended to be illustrative of ink fountains in general which store a supply of ink and meter it for transport and delivery to a printing plate. Ink fountain 10 includes a fountain roller 12 and blade 14 which cooperate to form an ink reservoir 16 for holding a supply of ink 18. The fountain roller rotates toward the ink reservoir, in the direction indicated by arrow 20. Ink from reservoir is metered through a gap formed at the point at which the end of blade 14 converges with fountain roller 12. In the illustrated ink fountain, as in most ink fountains, this point is under the fountain roller, on the reservoir side. Ink tends to stick to the surface of the fountain roller as it rotates through the ink 18. Ink is transferred through the gap and then to ducting roller 22 or a first roller in an ink train. Adjusting the gap between the blade and the roller changes the thickness of the layer or film of ink sticking to the surface of the fountain roller as the fountain roller rotates past the end of the blade 14. The end of the blade 14 is flexible so that it can be adjusted within predefined segments along the width of the ink fountain using keys 15.

Mounted on frame 11, above the ink fountain, is an ink management system for maintaining a minimum level of ink in the ink fountain, including a linear transport generally designated as 24, an ink dispenser 26 and an ink fountain level sensor 28. The linear transport moves the ink dispenser and the ink fountain level sensor across the width of the ink fountain. The linear transport which is illustrated includes a carriage 30 to which is mounted the ink dispenser 26 and ink fountain level sensor 28. An actuator moves and positions the carriage along track or rail 32 extending over and across the ink fountain. Any type of linear transport which can move the ink dispenser and the ink fountain level sensor across the ink fountain could be used.

The ink management system can be integrated into the printing press as original equipment. However, for purposes of demonstrating the adaptability of the ink management system to being retrofitted to the ink fountain 10, track 32 is shown attached or mounted to the top of frame 11 of the printing press by means of fasteners 34 which are bolted or secured to the top of each side of the frame and hooked into a slot on the track. If desired, the same track, as well as the same carriage, ink dispenser and ink level sensor, could be retrofitted to different types of printing presses of generally the same size with little need to specially adapt them. For this purpose, fasteners 34 may be positioned at least at several points along the length of the track so that they can be aligned with the frame 11 of the printing press. Each fastener 14 has a tongue which cooperates with a slot formed along at least each end portion of the track 32 to enable the fasteners to be hooked to the rail at any position along the slot and thus aligned with the sides of frame 11.

The actuator which moves the carriage 30 on the track 32 includes a motor 36 for powering a drive for moving and positioning carriage 30 on the track. The drive includes a screw 38 of fixed pitch which cooperates with a threaded portion of the carriage 30 to move and position the carriage linearly along the track. The motor is an electric step motor which turns the screw in fixed steps or increments of angle to precisely control rotation of the screw and, thus, positioning of the carriage. If desired, a servo mechanism could be used to control positioning of the carriage rather than a step motor. Other types of actuators could be used to position the carriage of the track. For example, the motor could be hydraulic or pneumatic rather than electric. The drive may be some other type of mechanical drive, for example a belt, cable or chain, or a pneumatic or hydraulic drive.

The linear transport ink dispenser 26 and ink fountain level sensor 28 are oriented with respect to the ink fountain 10 such that the nozzle 40 of the ink dispenser traverses or moves laterally across the width of the ink fountain above the fountain roller 20 and the ink fountain level sensor traverses the ink fountain above the ink 18 in the reservoir 16. This traversing is indicated by the carriage, ink dispenser and ink fountain level sensor outlined in dashed lines in a second position laterally displaced from the position in which they are illustrated using solid lines. The ink dispenser is mounted on the carriage using arm 42 so that the linear transport can be located in a position which does not interfere with dispensing operations. The ink fountain level sensor 28 is mounted on an arm 43 which extends outwardly over the in fountain, but to one side of the ink dispenser. As the carriage traverses during sensing and dispensing operations, the ink fountain level sensor leads the ink dispenser. If the ink fountain level sensor 28 senses a low spot, the ink dispenser, once it moves over the low spot, dispenses a predetermined amount of ink.

As the nozzle 40 is located over the fountain roller 12, ink which is dispensed falls onto the fountain roller and is then carried by the fountain roller towards the metering gap between the blade 14 and fountain roller 12. The fountain roller effectively forces the ink into the area of convergence between the blade 14 and the fountain roller 12, thus helping to ensure that enough ink is present at the metering gap to provide a continuous and uniform supply of ink. As there is no reliance on flowing of ink, the level of ink in the fountain may be kept very low and/or very viscous ink may be used. Preferably, the amount of ink which is dispensed is such that a small bead of ink, as shown in FIGS. 3 and 4, is set up and maintained by the ink management system in the area of the convergence of the blade 14 and the roller 12 as a consequence of depositing the ink on the roller and the rolling action of the fountain roller.

In operation, the width of the ink fountain can be logically divided into segments or increments for purposes of level sensing and dispensing of ink. The segments could, if desired, correspond to the segments of the blade 14 controlled by each of the keys 15. The level or amount of the ink in the segment is then determined by averaging or integrating a series of readings taken across the segment. The ink dispenser, once it is centered over the segment, dispenses the ink if the level is below a present level or amount.

Figure 2:
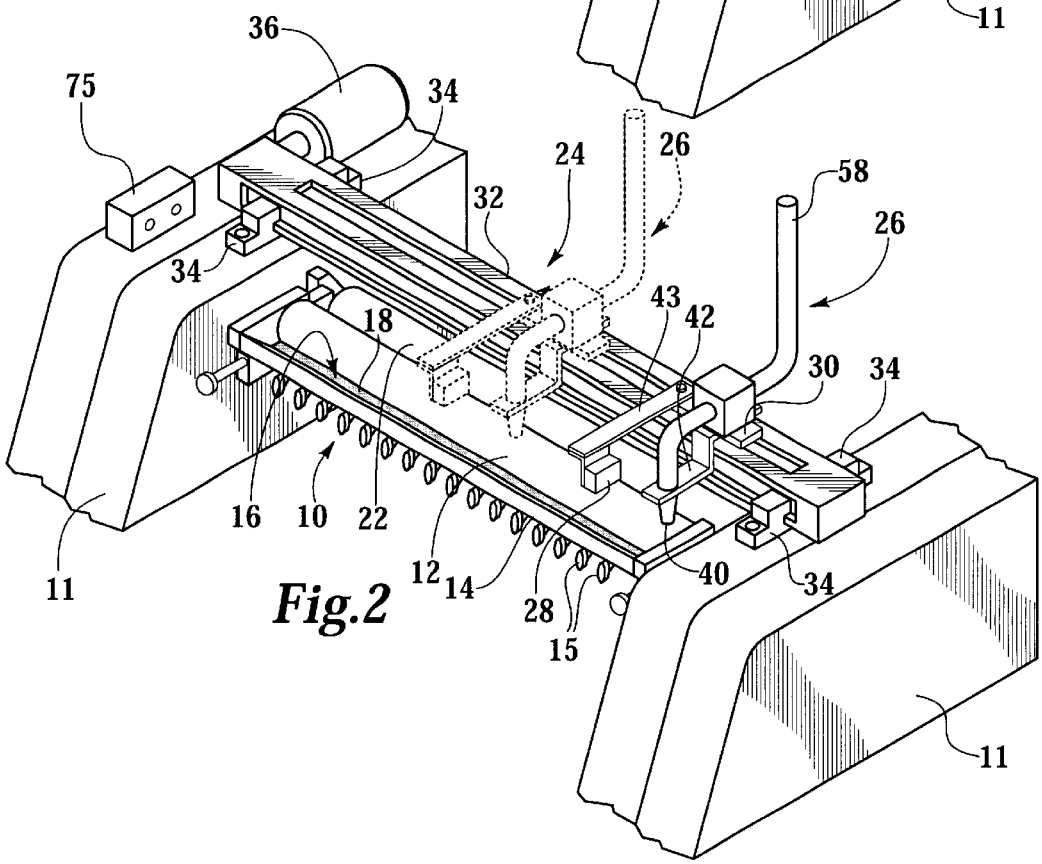
FIG. 2 is an isometric view of the representative ink fountain and ink train portion as shown in FIG. 1 with a second embodiment of the ink management system for automatically maintaining a predetermined minimum level of ink in the ink fountain.
Figure 4:
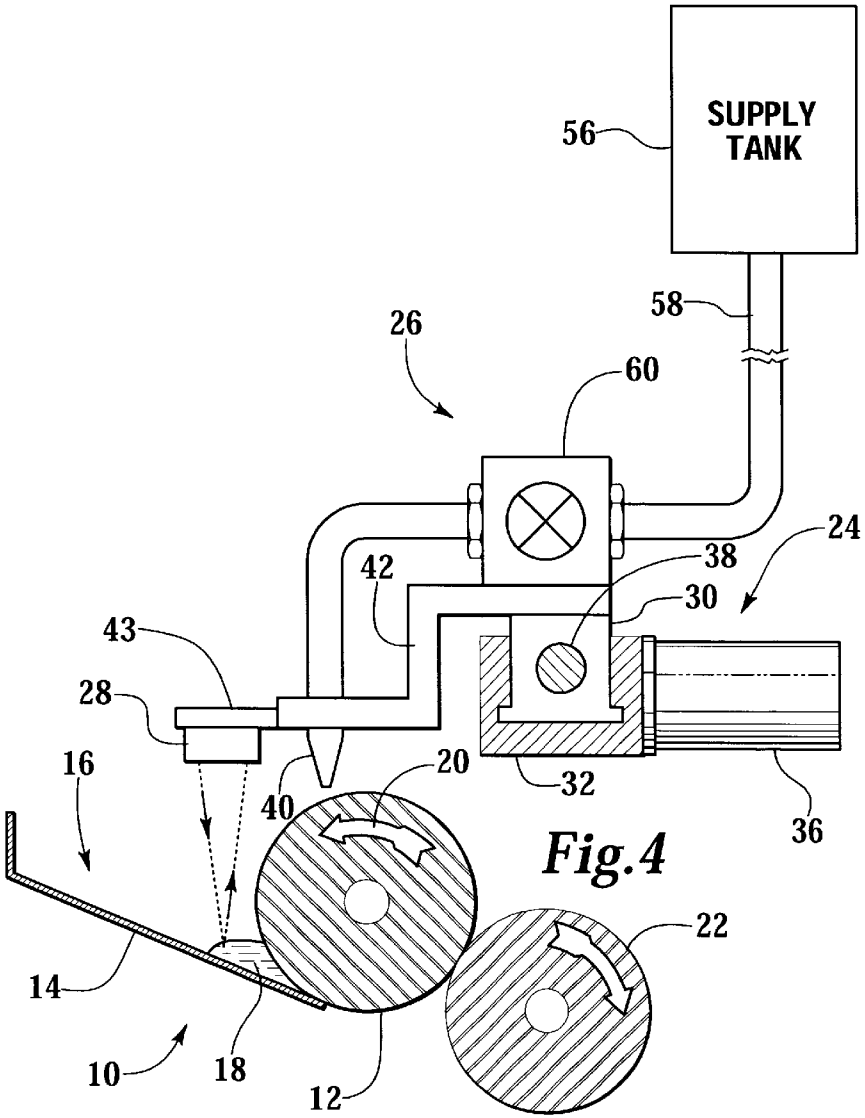
FIG. 4 is a schematic side view, taken partially in cross-section, of the second embodiment of the apparatus for automatically maintaining a predetermined minimum level of ink in the ink fountain shown in FIG. 2.
Figure 3:
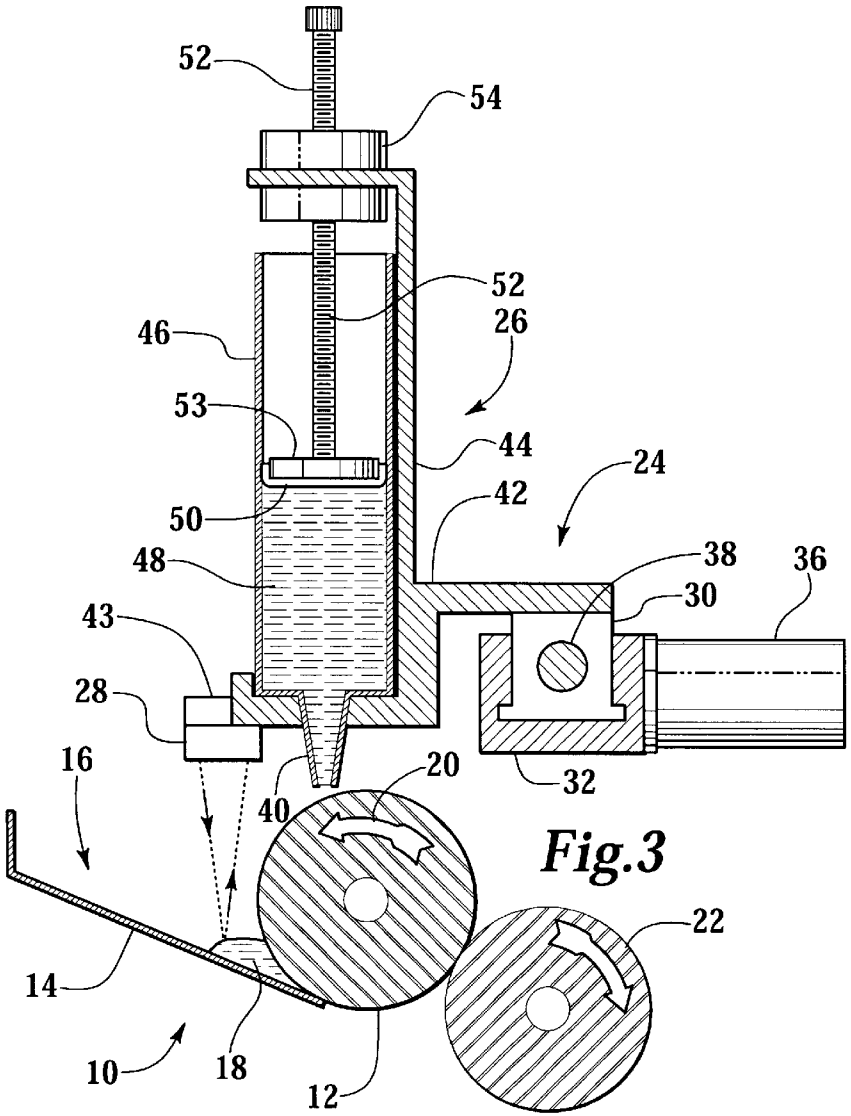
FIG. 3 is a schematic side view, taken partially in cross-section, of the first embodiment of the apparatus for automatically maintaining a predetermined minimum level of ink in the ink fountain shown in FIG. 1.

Two embodiments of ink dispenser 26 are disclosed, one in FIGS. 1 and 3 and the other in FIGS. 2 and 4. Each includes a nozzle in fluid communication with a form of bulk ink supply. Referring now only to FIGS. 1 and 3, the first embodiment of the ink dispenser 26 includes a cartridge holder 44 in which is located an ink cartridge 46. Ink for lithographic printing presses is commercially sold in such a cartridge. It has the shape of a hollow cylinder and stores a supply of ink 48, which ink is only indicated in FIG. 3. A sliding, disc-shaped plunger 50 which seals an open top end of the cylinder. The bottom end of the cylinder is formed into a dispenser outlet in the form of nozzle 40. Although not shown, the dispenser nozzle can be closed or capped once opened to keep the ink in an air tight enclosure for storage. To use the cartridge, the nozzle 40 is opened and the cartridge inserted into the holder. A rod 52 and piston 53 depending from rod 52 are moved to engage the plunger 50. The rod and piston, when displaced downwardly by actuator 54, pushes ink out of the nozzle 40 of the cartridge and onto the fountain roller 20 below. The rod and piston are actuated by a step motor engaging screw threads formed on the end of the rod. The step motor moves in small, predefined increments or steps, allowing controlled displacement of the piston. Thus, predetermined amounts of ink may be dispensed from the cartridge and the total volume and weight of ink dispensed during a run can be tracked for accounting or charging by counting the number of steps taken by the motor. The position of the piston, as indicated by the number of steps or by a sensor which measures the rotation of the screw, will indicate the amount of ink left in the cartridge. Rather than a stepper motor and screw, an electric, hydraulic, pneumatic or other type of actuator or servomechanism could be used to control the displacement of ink from the cartridge. The cartridge is especially advantageous for use with highly viscous ink such as ink used on photolithographic offset printing presses, as the positive displacement provides good control over the amount of ink dispensed. Furthermore, use of the cartridge enables small amounts of ink to be mixed and stored.

Referring now only to FIGS. 2 and 4, the second embodiment of the ink dispenser 26 receives ink from bulk supply of ink stored in a tank 56 remotely located from the ink fountain or printing press through a flexible hose or pipe 58. The ink in the hose is placed under a predetermined pressure, either by a pump or by a head formed in the supply tank. Metering valve 60 includes an actuator operated valve which is opened for a predetermined interval to meter a predetermined amount of ink through the valve. This metered ink flows through dispensing nozzle 40 and onto the fountain roller. Generally, dispensing of ink in this manner is suitable primarily for less viscous inks.

Figure 5:
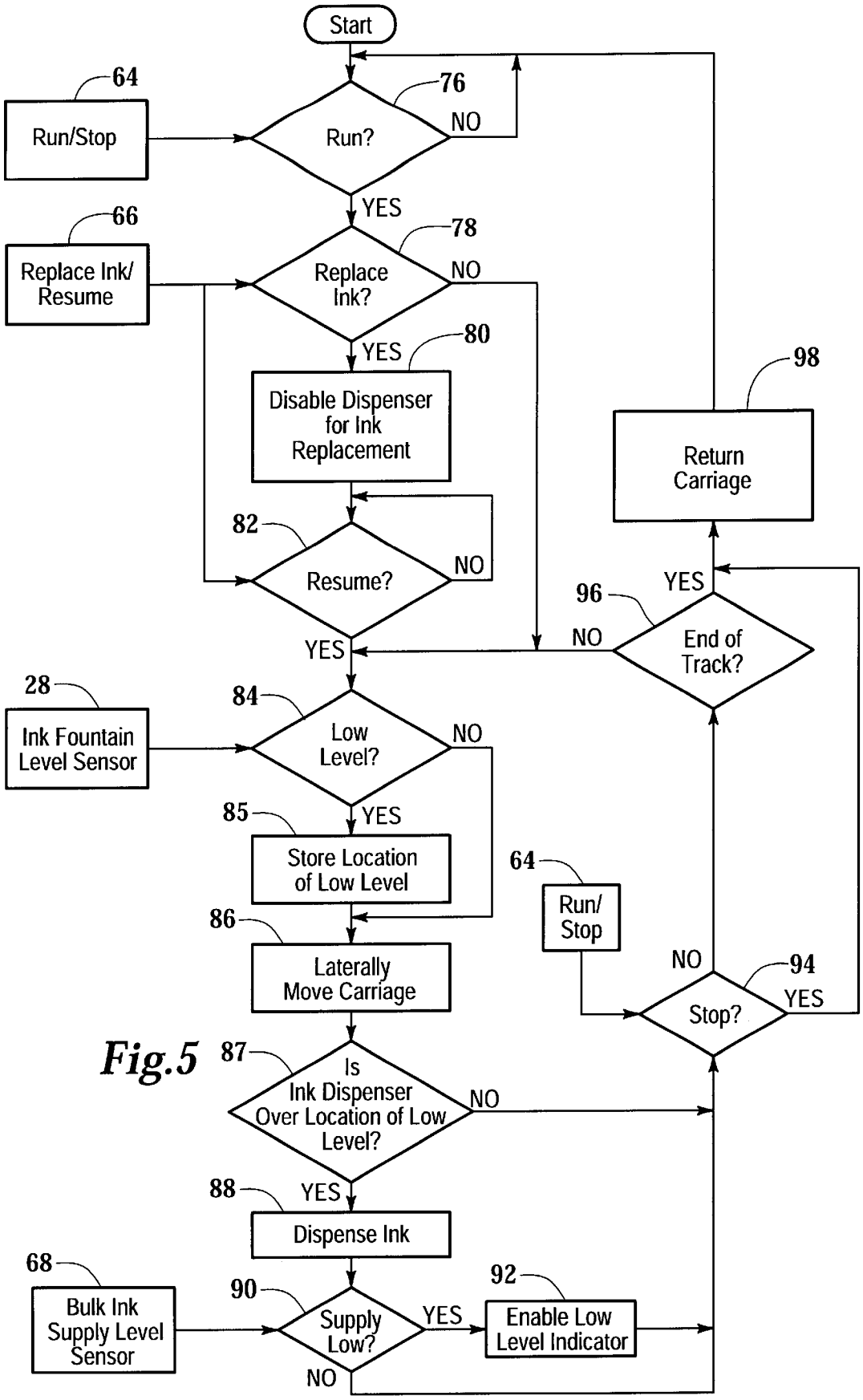
FIG. 5 is a flow chart illustrating process steps of the apparatus for automatically maintaining a predetermined minimum level of ink in the ink fountain.
Figure 6:
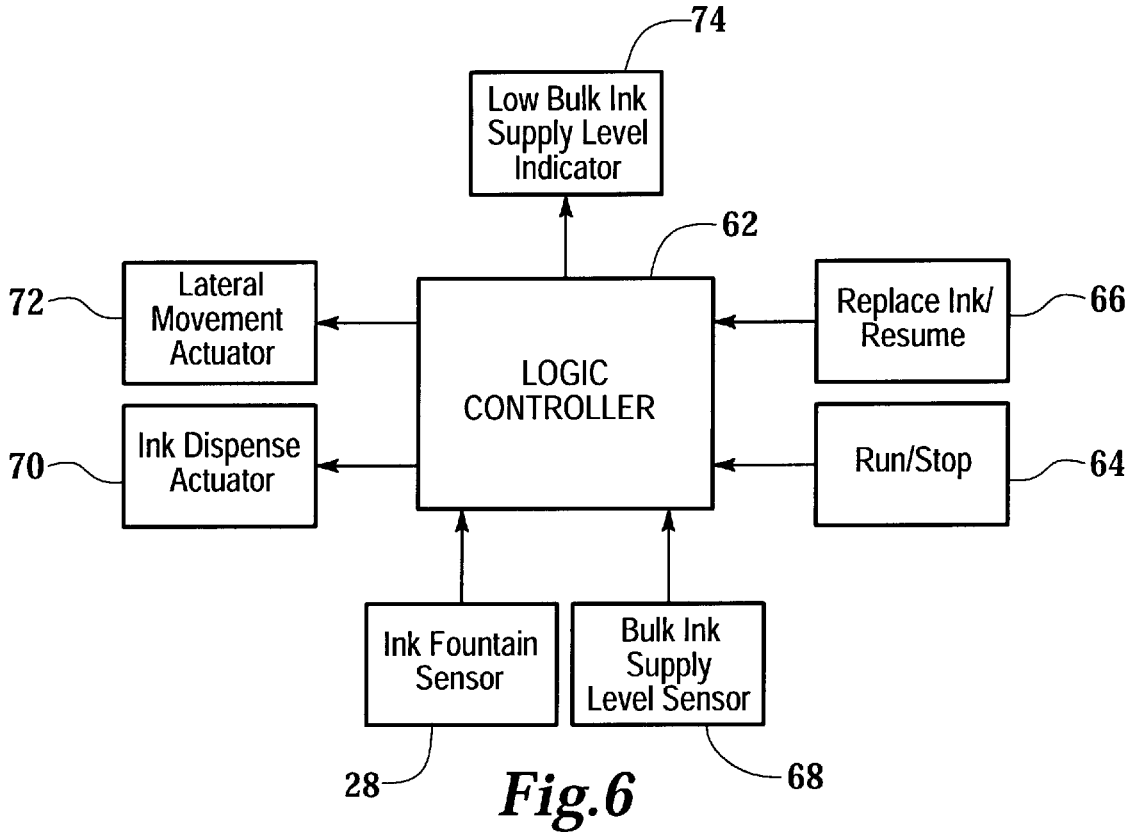
FIG. 6 is block schematic circuit diagram of circuits for carrying out the process illustrated by FIG. 5.

Referring to FIGS. 5 and 6, controller 62, which is shown only in FIG. 6 provides control signals to the various actuators and receives various signals from sensors or, depending on the type of actuators used, feedback signals, in order to operate the ink management system according to the method illustrated by the flow chart of FIG. 5. Although not illustrated, the controller includes an automatic control system having control logic or circuits. These circuits can be hardwired or programmable. Program instructions could be stored either as firmware or software. For example, they may take the form of a logic circuit or a programmable logic array, microcontroller or computer. Furthermore, the controller includes control sub-systems which translate commands generated by the control logic to appropriate signals for the mechanical actuators used in the ink management system, as well as interface and input/output circuits which send and receive data and control signals for sensors, displays and manual input devices such as switches, buttons, keyboards, etc.

Referring briefly to FIG. 6, the controller 62 receives signals from the following: a manually operated run/stop switch 64 for a pressman to indicate whether to run or stop ink level sensing and dispensing; a manually operated replace ink supply/resume switch 66 for pausing operation of the ink management system in order to replace or refill the bulk ink supply (either cartridge 46 or tank 56) of the ink dispenser 26; an ink supply level sensor 68 for indicating a low amount of ink in the bulk supply for the ink dispenser 26; and the ink fountain level sensor 28. The controller transmits control signals to the following: lateral movement actuator 70 (step motor 36 in the illustrated embodiments) of the linear transport 24; ink dispense actuator 72 (step motor 54 or valve 60 in the illustrated embodiments); and low bulk ink supply level indicator 74. The controller 62, its power supply and any additional electronic control circuits may be housed in enclosure 75 mounted to frame 11 as shown in FIGS. 1 and 2. The enclosure may include a control panel for switches and visual indicators.

Referring now to FIGS. 5 and 6, the ink management system will not proceed past decision step 76 until the run/stop switch 64 indicates run. At decision step 78, if the replace ink/resume switch 66 indicates that a pressman desires to replace or replenish the bulk ink supply of the ink dispenser 26, then the logic controller disables the ink dispenser 26 at step 80 in order to permit replacement. In the case of the embodiment shown in FIGS. 1 and 3, the controller causes actuator 54 to back out the rod 52 and piston 53 from the cartridge 46 and returns the carriage to one side of the ink fountain mi order to permit the cartridge to be removed and a new one replaced. After replacement of the cartridge into the holder, the piston is placed against the seal. In the second embodiment of FIGS. 2 and 4, disabling the ink dispenser involves turning off the pressure on the ink in the hose 58. Once the bulk ink supply is replaced or replenished, the pressman resumes operation by moving the replace ink/resume switch to resume, as indicated by decision step 82.

At decision step 84, the controller 62 checks the signals from the ink fountain level sensor 28. If the sensor indicates that the ink level is below a predetermined ink level, the location or position of the low spot is noted, stored or remembered at step 85, by setting a flag, recording in memory a numerical position, or some other method, and the ink dispenser 26 and the ink fountain level sensor 28 are moved laterally across the ink fountain by the controller causing actuation of the lateral movement actuator 72. In the illustrated embodiment, this movement is accomplished in the disclosed embodiment by the controller stepping the step motor 36 (FIGS. 1–4) to move carriage 30. If a low level is not detected, the process moves directly to step 86.

At step 87, the controller determines whether the ink dispenser is over a location of a low spot in the ink in the ink fountain. If it is, then ink is dispensed at step 88. To dispense ink, the controller 62 causes ink dispense actuator 70 to dispense ink from the ink dispenser 26 and into the ink fountain. In the embodiment shown in FIGS. 1 and 3, the controller steps motor 54 a predetermined number of times. In the embodiment of FIGS. 2 and 4, the controller opens the metering valve 60 for a predetermined period. After dispensing ink, the controller 62 checks, at step 90, the bulk ink supply level sensor 68 to determine whether the bulk ink supply is low. If the supply is low, a low bulk supply level indicator is activated or enabled at step 92, and then the process proceeds to step 94. If the ink dispenser is not over a location at which there is a low spot at step 87, the process moves directly to step 94.

If the run/stop switch 64 is still on run at step 94, the controller then determines at decision step 96 whether carriage 30 for the ink dispenser and ink fountain level sensor is at the edge of the ink fountain, particularly whether it is at the end of the track 32 of the linear transport. If so, the controller causes the lateral movement actuator 72 to return, at step 98, the cartridge to the beginning side, and the process returns to step 76 to continue. Otherwise, the process loops back to step 84. If, at step 94, the pressman has stopped the ink management system by switching ran/stop switch to stop, the process skips to step 98.

As previously indicated, the width of the ink fountain can be logically divided into a series of segments or intervals for purposes of measuring ink levels and dispensing ink. These segments may be aligned with the keys 15 (FIGS. 1 and 2) on the ink fountain, with one or more segments to a key. The ink fountain level sensor 28 and ink dispenser 26 is, during operation, moved or stepped in a substantially continuous fashion. The ink fountain level sensor makes several readings across each segment in order to determine an overall level of ink or amount of ink in that segment of the ink fountain. The readings can be integrated or averaged over the segment to determine the amount overall level of ink in that segment. Having the ink fountain level sensor 28 lead the ink dispenser 26 enables the sensor to scan an entire segment before determining whether additional ink is required in that segment and before the ink dispenser is positioned next to the segment for dispensing. Depending on the amount of ink to be dispensed, the width of the segment and the speed at which the nozzle 40 of the ink dispenser 26 is moving during dispensing, ink may be deposited across the width of a segment or substantially around the center of a segment. If necessary, the controller could pause movement of the carriage during dispensing.

The controller can be adjusted to set the amount of ink which is dispensed at step 88 at a fixed amount. The amount is set based, in part, on trial and error. A minimum desirable ink level should be determined. The minimum desirable level should be at or above the level which, at a maximum rate of consumption, there is minimum acceptable risk of ink starvation developing during the time it takes the ink dispenser 26 is to complete a full cycle across the ink fountain. The preset amount of ink which is dispensed should be sufficient to bring the ink level at least to the minimum desirable level during one dispense cycle. Alternately, the controller could determine the amount of ink to be dispensed into a segment to bring it within a desirable range depending on the level or amount of ink determined for that segment.

Figure 7:
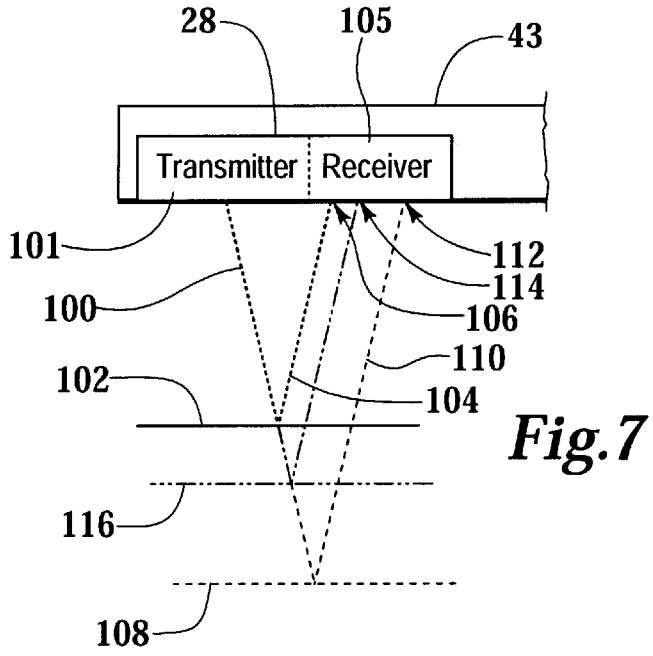
FIG. 7 is a schematic illustration of a photoelectric proximity sensor used to measure ink levels in an ink fountain.

Referring now to FIG. 7, the ink fountain level sensor 28 is a photoelectric proximity type sensor which measures ink by shining a narrow optical beam 100 generated in a transmitter portion 101 of the sensor, toward the ink reservoir 16 in the ink fountain 10. The beam will reflect off the surface 102 of the ink and a portion 104 of the beam will return toward a receiver portion 105 of the sensor at a point 106. Surface 102 indicates an acceptable level of ink in the ink fountain. An unacceptably low level 108 is illustrated in phantom by broken lines. The portion 110 of the beam 100 reflecting off the low level 108 hits the sensor at point 112, which point is displaced laterally outwardly from point 106. A minimum acceptable ink level 116 reflects a portion of beam 110 to point 114 on the receiver portion 10 of the sensor. An infrared energy detector is oriented within the receiver portion 10 for detecting portions of the beam which strike the sensor at points to the left, or toward beam transmitter 101, of point 114 and for indicating with a signal, detection of the return portion of the beam. A commercially available sensor which functions according to the forgoing principles is a SENSICK Model WT4 opto-electronic sensor from Sick Opto-Electronic, Inc. of Eden Prairie, Minn. The sensor may also use an infrared energy detector which provides an analog or continuously variable output signal which indicates where the return portion of the beam 100 hits the sensor, thus providing a means, once calibrated, for determining the actual distance between the ink fountain level sensor and the surface of ink in the ink fountain 10, from which the actual ink level within the fountain may be easily ascertained. Such a sensor is SENSICK Model WT18 sold by Sick Opto-Electronic, Inc. of Eden Prairie, Minn.

Figure 8:
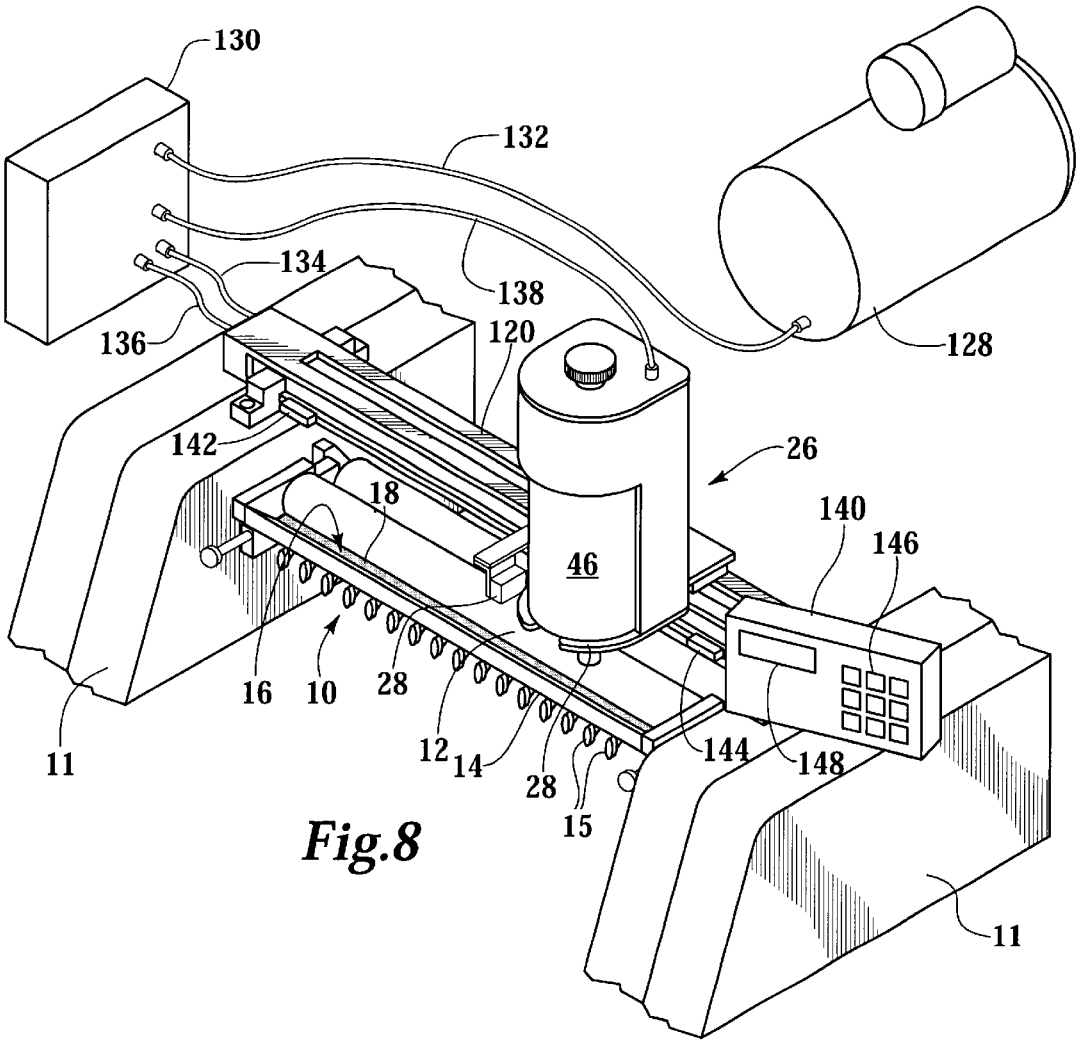
FIG. 8 is an isometric view of another embodiment of an ink management system mounted to an ink fountain of a printing press.
Figure 9:
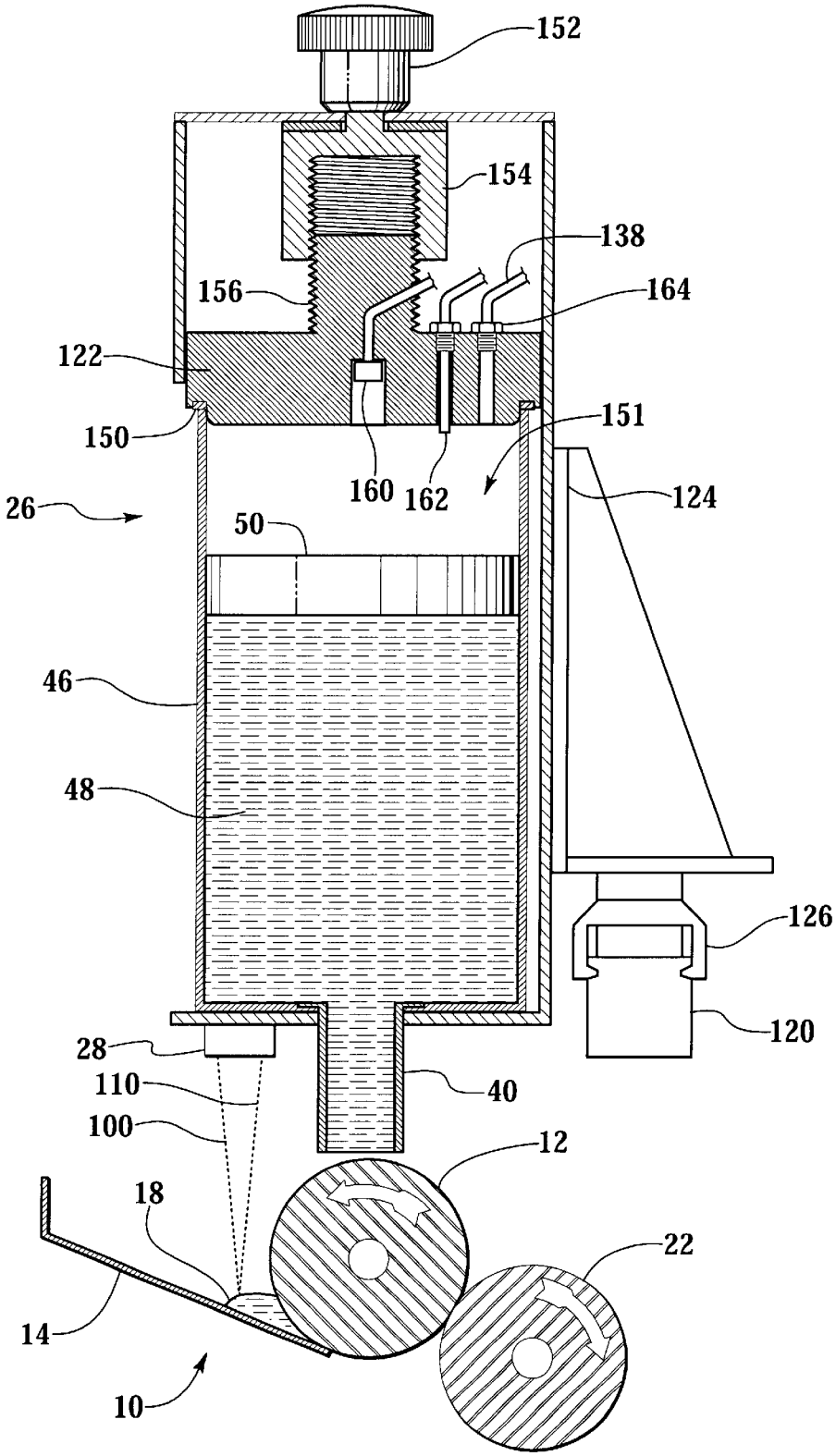
FIG. 9 is a side-view of the ink management system shown in FIG. 8, with an ink dispenser partially-sectioned and the ink fountain illustrated schematically.

Referring now to FIGS. 8 and 9, another embodiment an ink management system includes a linear transport in the form of a pneumatic, linear actuator 120 for moving ink dispenser 26 and ink fountain level sensor 28 across the width of the ink fountain 10. Pneumatic linear actuators are well known and operate according to well known principles. Briefly, the pneumatic linear actuator is comprised of an elongated enclosure defining an internal chamber into which compressed air may be flowed to move a carriage 126 mounted on a track formed by the elongated enclosure. The ink dispenser 26 and ink fountain level sensor 28 are mounted to the carriage.

The ink dispenser 26 includes, in this embodiment, a pneumatic head (not visible) supported by a frame 124. The pneumatic head acts as an actuator to push ink from ink cartridge 46. Frame 124 allows ink cartridge 46 to be positioned below the pneumatic head and held in place.

Compressed air for driving the pneumatic linear actuator 120 and the pneumatic head of the ink dispenser is generated by air compressor 128. Compressed air flows through supply hose 132 to pneumatic circuits (not shown). The pneumatic circuit is operated by a process controller (not shown). The pneumatic circuits include solenoid-controlled valves, flow control valves and pressure regulating valves arranged in a conventional manner to supply compressed air to the linear actuator through hoses 134 and 136 so that the carriage may be moved in either direction along its track at predetermined rates and for predetermined distances. The pneumatic circuit also connects compressed air to the pneumatic head through hose 138 to cause a predetermined amount of ink to be dispensed from the ink cartridge 46. The valves for the pneumatic circuits are located within the housing 130, together with power supplies for the solenoid operated valves, and process controller and other electrical systems.

Proximity switches 142 and 144 are tripped when carriage 126 has reached its end of travel at one end the linear actuator 120, opposite control panel 140 and its home position next to the control panel, respectively. Control panel 140 includes buttons 146 to change modes of operation of the ink management system and to control manually the position of, and dispensing from, the ink dispenser when the ink management system is in a manual mode. Display 148 visually indicates the mode of operation, ink usage and is located within control panel 140. The process controller supplants buttons 64 and 66 in FIGS. 5 and 6 used to control the mode of operation in the previously described embodiment.

Referring now to FIG. 9, when supplied with compressed air, pneumatic head 122 exerts an even pressure across the plunger 50 of the ink cartridge in order to displace or force ink 48 through nozzle 40. The pneumatic head includes a gasket 150. The pneumatic head is, in this embodiment, manually movable. When extended, the pneumatic head engages an open end of the ink cartridge defined by a cylindrical outer wall of ink cartridge 46 to define an air chamber 151. The pneumatic head may be manually retracted into the frame 124 to allow the ink cartridge to be inserted into position within, and to be removed from the frame. Turning knob 152 rotates an internally threaded, cylindrically-shaped coupling 154. Rotating coupling 154 moves rod 156 linearly due to external threads on the rod mating with those on the inside of coupling 154. Translation of rod 156 extends and retracts the pneumatic head 150, to which the rod is attached. Mounted within a hollow passage defined through the center of pneumatic head 150 is an ultrasonic, range-finding transducer 160 for use in determining the distance to the sliding, piston-like seal 50 of the ink cartridge. By measuring this distance and knowing the dimensions of the ink cartridge and the position of the transducer relative to the cartridge, the ink remaining in the cartridge and the amount of ink dispensed during a job can be determined. To compensate for changes in the velocity of sound cause by temperature (i.e. density) variations, the temperature of the air within chamber 151 is measured using temperature probe 162. Compressed air enters the air chamber 151 through inlet port 164. Inlet port 164 is connected with supply hose 138. The pressure within the chamber determines the rate at which ink is dispensed from the nozzle 40. The ink within the cartridge will not flow through the nozzle 40 without applying at least a minimum pressure to plunger 50 in excess of the atmospheric pressure. Ink deposited onto roller 12 from nozzle 40 is carried into the ink fountain 10 in the manner previously described. The pneumatic circuit in housing 130 (FIG. 8) includes a solenoid-operated valve for connecting compressed air to the pneumatic head 122, and a valve to vent automatically the air chamber 151 when the compressed air is disconnected.

Figure 10:
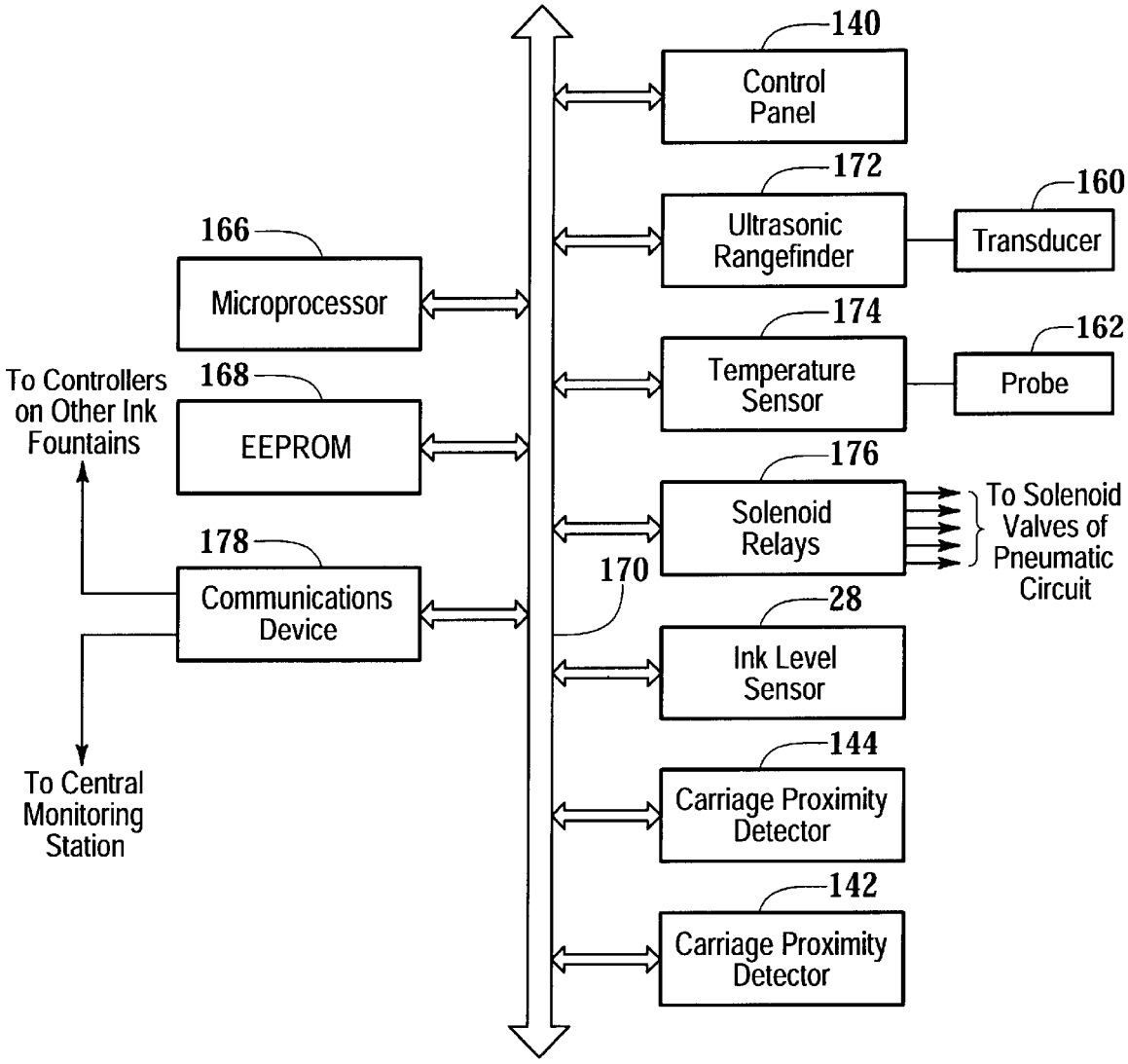
FIG. 10 is a schematic diagram of process control circuitry for the ink management system of FIG. 8.

Referring to FIG. 10, a schematic block diagram, process controller for the embodiment of the ink management system shown in FIGS. 8 and 9 may, like that for embodiment shown FIGS. 1–4, take the form of a programmable, general purpose microprocessor 166 and a software program code stored in a non-volatile memory, such as an electronically erasable, programmable, read only memory (EEPROM) 168. The programmability provides the advantage of easy modification to the operation and processes of the ink management system. The microprocessor communicates with the EEPROM (which alternately could be on board the microprocessor) and the other external devices through one or more system busses, which are represented by bus 170. These devices include control panel 140, ultrasonic range-finder 172, temperature sensor 174, solenoid relays 176, ink level sensor 28 and carriage proximity switches 142 and 144. Each of these devices is schematically illustrated and include any necessary circuits for interfacing with the microprocessor. The solenoid relays, when activated in response to signals from the microprocessor, selectively connect power to each of the solenoid-controlled valves in the pneumatic circuit (not shown) for driving the pneumatic linear actuator 120 and pneumatic head 122 of the ink dispenser 26 in the manner indicated by the microprocessor. The microprocessor and memory are located within the control panel 140 (FIG. 8). The remaining devices may be located, in whole or in part, elsewhere, including in housing 130 (FIG. 8), and connected by a wiring harness.

No particular form, layout or arrangement of the microprocessor and its interface with the memory and the other external devices is intended to be implied by the schematic illustration. There is no limit on the type of general purpose microprocessor systems and software to operate the ink management system according to the processes described below in connection with FIGS. 11–17. Also, application specific circuitry could also be used instead of a general purpose, programmable microprocessor, but with less flexibility in design and subsequent modification of the processes.

Communications device 178 enables data on, for example, ink consumption and the amount of ink remaining in cartridge, be sent to another computer or device. It allows the controller to receive commands, new programming or diagnostic evaluation. Furthermore, in a multi-color press, each ink fountain could be connected to a central computer in daisy-chain fashion, as indicated in FIG. 10, to enable central monitoring, control and programming of all the ink fountains on a press, or even in a printshop. Remote, off-site diagnostic routines could also be performed through the communications device 178 through such a network if connected to a telephone or other type of communications line.

The operation of the ink management system and ink dispensing processes are illustrated by the flow charts of FIGS. 11–16. The operation and processes may, as previously described, be under the control of a software program running on a microprocessor, such as microprocessor 166 (FIG. 10). However, all hardware, or different combinations of other types of hardware circuits and software, could be used to form a logic controller for directing these processes. A microprocessor offers the advantage of easily altering the processes if necessary or desirable.

Figure 11:
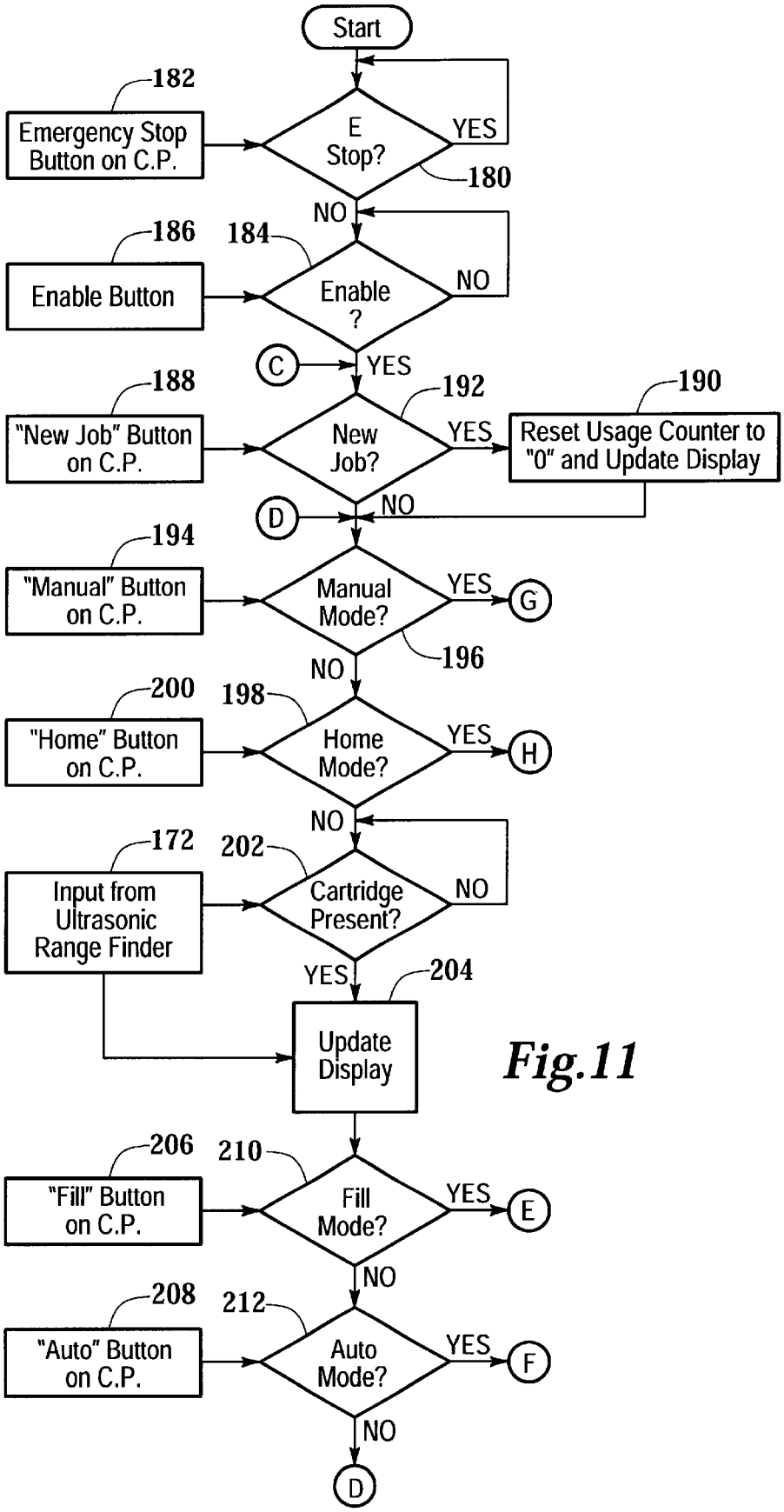
FIG. 11 is a flow chart illustrating the beginning of, and mode selection in, control processes of an ink management system, such as the ones shown in FIGS. 1 and 8, for dispensing ink into an ink fountain of a printing press.

Referring to FIG. 11, after power-up, the microprocessor determines if the ink management system has been stopped or disabled. As indicated by decision step 180, if an emergency stop button 182 on the control panel 140 is pushed, the process holds until it is reset. At decision step 184, if "enable" button 186 is not on, the process pauses until the button is pushed. As indicated by decision step 192, a pressman may indicate that a new job is beginning by pressing "new job" button 188 on the control panel, in which case a usage counter (which is implemented as a software routine) is set equal to zero at step 190.

The ink management system may have several modes of operation, including "manual," "home," "fill" and "auto."

Figure 12:
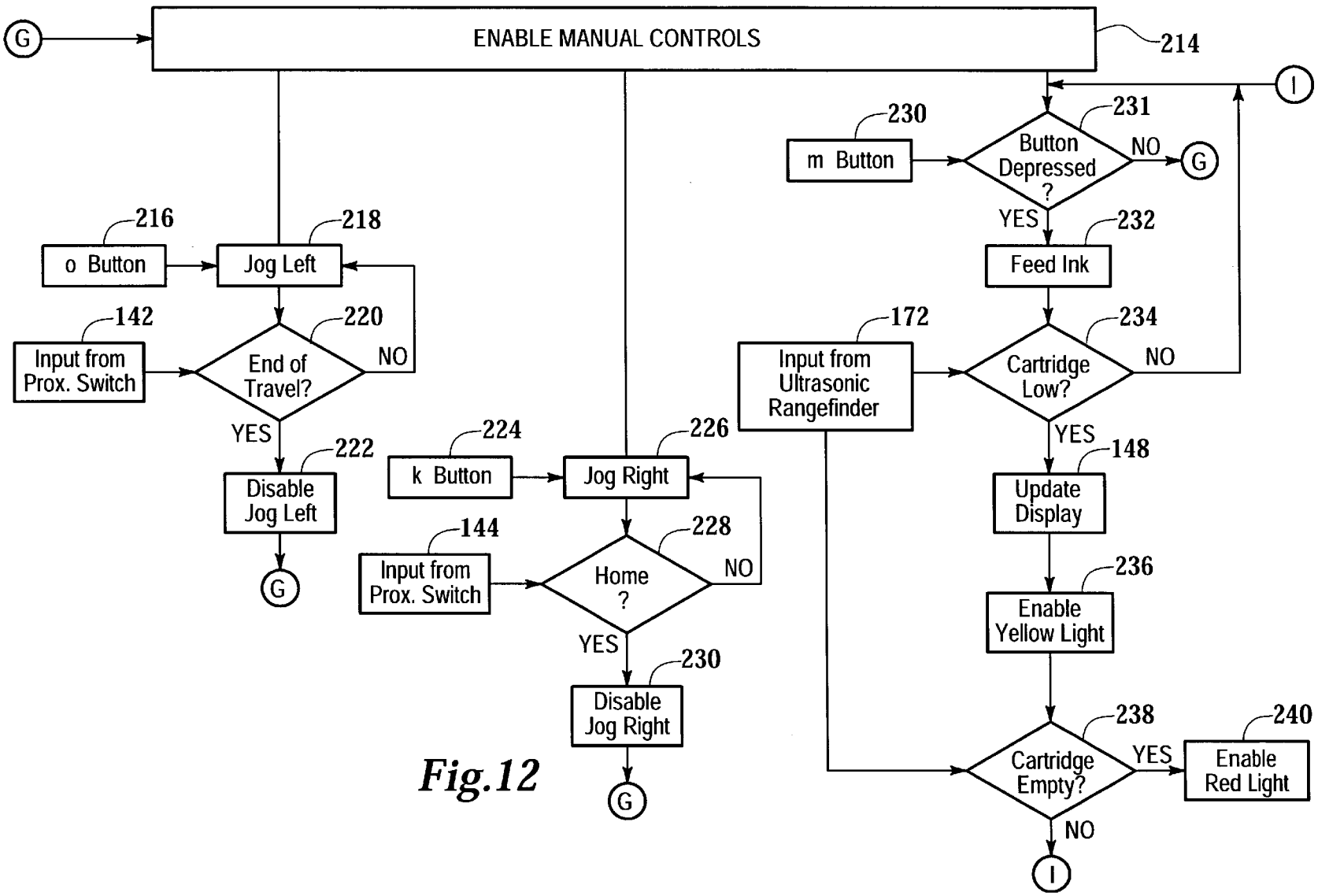
FIG. 12 is a continuation of the flow chart of FIG. 11 illustrating a manual control process.

The mode of operation selected by a pressman determines which processes the ink management system performs. If"manual" button 194 is pressed on the control panel, the process illustrated in FIG. 12 is executed as indicated by decision step 196. As indicated by decision step 198, depressing a "home" button on the control panel causes the process illustrated in FIG. 13 to execute. If neither manual nor home modes are entered, the process will not continue unless an ink cartridge is loaded in the ink dispenser 26. In the embodiment of FIG. 8, this is determined by checking ultrasonic ranger finder 172. As the only two remaining modes involve automatic dispensing of ink, this check prevents the modes from being accidentally or unnecessarily entered. At step 204 the amount of ink in the ink cartridge is calculated based on the input from the ultra-sonic range finder and display 148 (FIG. 8 embodiment) is updated with ink cartridge level information, including the amount of ink in the cartridge. Depending on whether "fill" button 206 or "auto" button 208 on the control panel is pushed, the process of either FIG. 14 or FIG. 15, respectively, is entered, as indicated by decisions steps 210 and 212.

Referring to FIG. 12, manual mode allows a pressman to maneuver the ink dispenser 26 to any position along its linear transport and to dispense ink. Once the manual mode is entered, manual controls are enabled at step 214. The manual controls are located on the control panel 140 (FIG. 8). If "arrow left" button 216 is depressed, the ink dispenser 26 (FIGS. 1 and 8) is moved to the left over the fountain by actuation of the transport on which it is mounted (for example pneumatic linear actuator 120 of FIG. 8), as indicated by step 218. As indicated by decision step 220, if the input from the proximity switch 142 does not indicate that the end of travel of the ink dispenser has been reached. The ink dispenser is jogged left so long as the "arrow left" button is depressed and the end of travel is not reached. Once the end of travel is reached, the left jog is disabled at step 222, and the process returns to step 214 to await input from any of the manual buttons. If the "arrow left" button is not depressed, the process returns to step 214. The "arrow right" button causes the ink dispenser to move to the right, as indicated by step 226. With input from proximity switch 144, the processes does not permit, as indicated by decision step 228 and step 230, further right jogs once the ink dispenser reaches home. Again, like the "arrow left" button, once the "arrow right" button is no longer depressed or when the ink dispenser reaches home, the process returns to step 214.

To manually cause ink to be dispensed from the ink cartridge, a pressman depresses "arrow down" button 230. As indicated by decision step 231, this results in the ink dispenser 26 feeding ink at a predetermined rate at step 232. At decision step 234, the ultra-sonic range finder is checked. If it indicates that ink cartridge is low, the display 148 is updated with the new level and a yellow warning light 236 on the control panel 140 (FIGS. 1 and 8) is illuminated. As indicated by decision step 238, a red warning light 240 is illuminated once the ink cartridge is empty.

Figure 13:
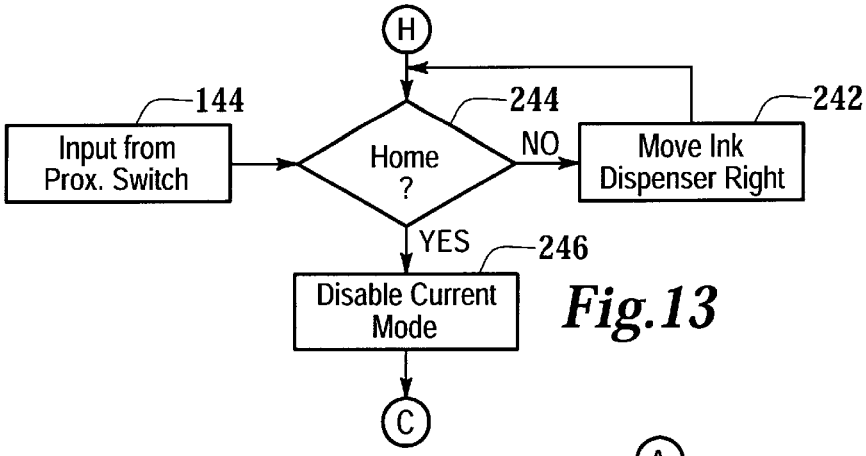
FIG. 13 is a continuation of the flow chart of FIG. 11 illustrating an ink dispenser homing routine.

Referring to FIG. 13, when the "home" mode switch is depressed, the ink dispenser is automatically moved toward the "home" position at the end of the linear actuator 122 (or other type of linear transport) next to the control panel 140 (FIG. 8) at step 242. As indicated by decision step 244, once the proximity switch 144 (FIG. 8) is activated by the ink dispenser 26 reaching home, the "home" mode is disabled at step 246. The home mode is useful to bring the ink dispenser next to the side of the fountain so that it can be inspected or the ink cartridge replaced.

Figure 14:
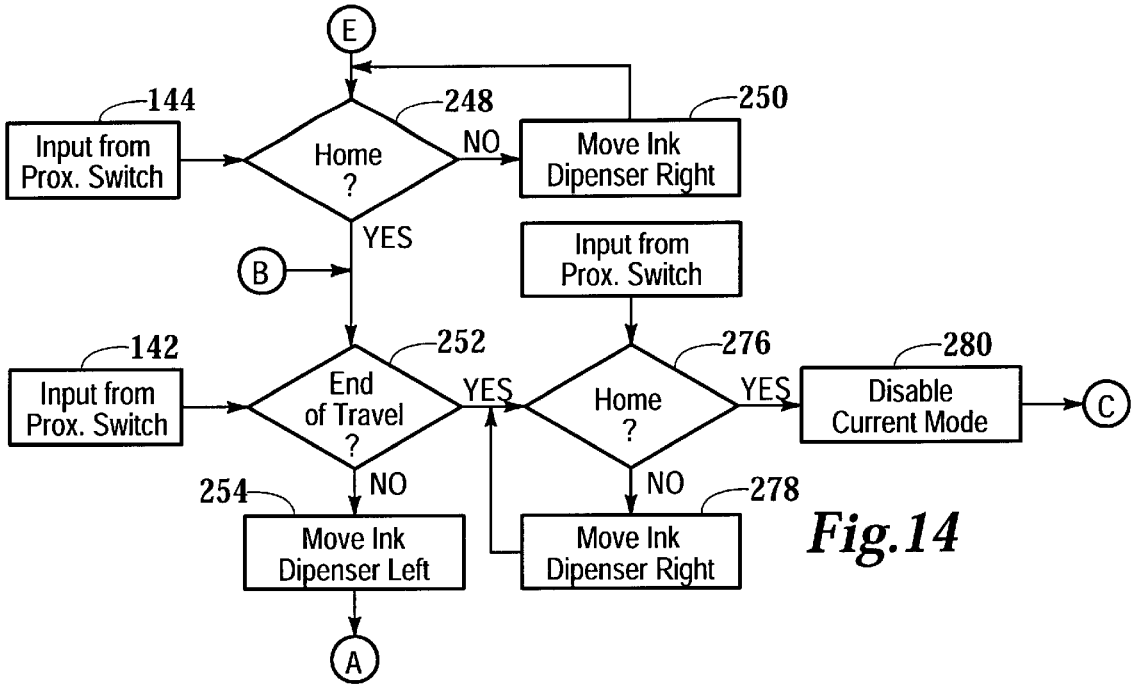
FIG. 14 is a continuation of the flow chart of FIG. 11 illustrating an automatic, initial fill routine.

Referring to FIG. 14, in "fill" mode the ink dispenser 26 (FIGS. 1 and 8) is automatically traversed across the ink fountain while it is dispensing ink for the purpose of depositing an initial amount of ink into the fountain at, for example, the beginning of a job. First, as indicated by decision step 248 and step 250, the ink dispenser is moved to the home position. The process then proceeds past decision step 252 to 254 since the ink dispenser not being at the end of travel on the linear transport. At step 254, the ink dispenser is moved left a predetermined distance. The process then proceeds to an ink feed cycle.

Figure 15:
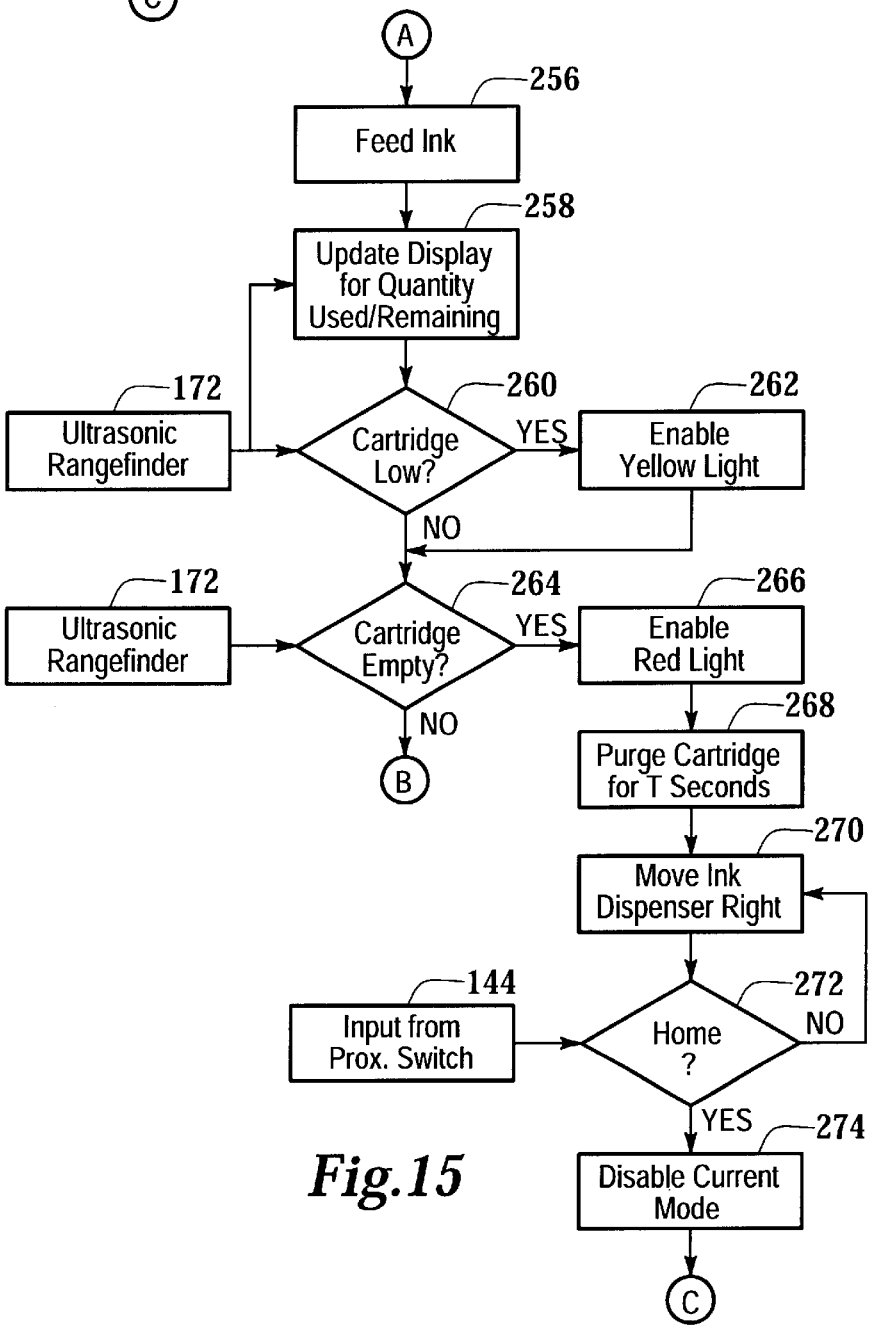
FIG. 15 is a continuation of the flow chart of FIG. 14 and the FIG. 16, depending on the mode of operation of the ink management system, and illustrates an ink dispense cycle.

Referring now to FIG. 15, which illustrates an ink feed process cycle, the ink dispenser dispenses at step 256 a predetermined amount of ink. At step 258, the amount of ink in the ink cartridge 46 (FIGS. 1 and 8) in the ink dispenser remaining, as well as the amount used since the last time the "new job" button 188 (FIG. 11) was pushed, is calculated and the display 148 (FIG. 8) updated with the current amount of ink in the cartridge. Additionally, if the amount of ink in the ink cartridge is low, the yellow, low ink warning light is enabled, as indicated by steps 260 and 262. If, at decision step 264, the ink cartridge is also empty, the red light on the control panel is enabled at step 266, and dispensing continues for another "T" seconds to purge the ink cartridge complete of ink at step 268. As indicated by step 270 and decision step 272, the ink dispenser 26 is moved to the "home" position so that a new, cartridge of ink may be loaded. At step 274, the current mode is disabled and the process returns to decision step 192 (FIG. 11). If the cartridge is not empty at decision step 264, the ink feed cycle returns, if the system is in "fill" mode, to step 252 of FIG. 14.

Referring back to FIG. 14, as indicated by decision step 252, so long as the end of travel of the ink dispenser has not been reached, it continues to traverse, as indicated step 254, and enters the ink feed cycle at step 256 (FIG. 15) again to feed the predetermined amount of ink. This left movement and ink feed cycle is repeated (in effect it is continuous) until the end of travel is reached. When the end of travel is reached the ink dispenser is returned home, as indicated by decision step 276 and step 278. When the home position is reached, the fill mode is disabled at step 280.

Figure 16:
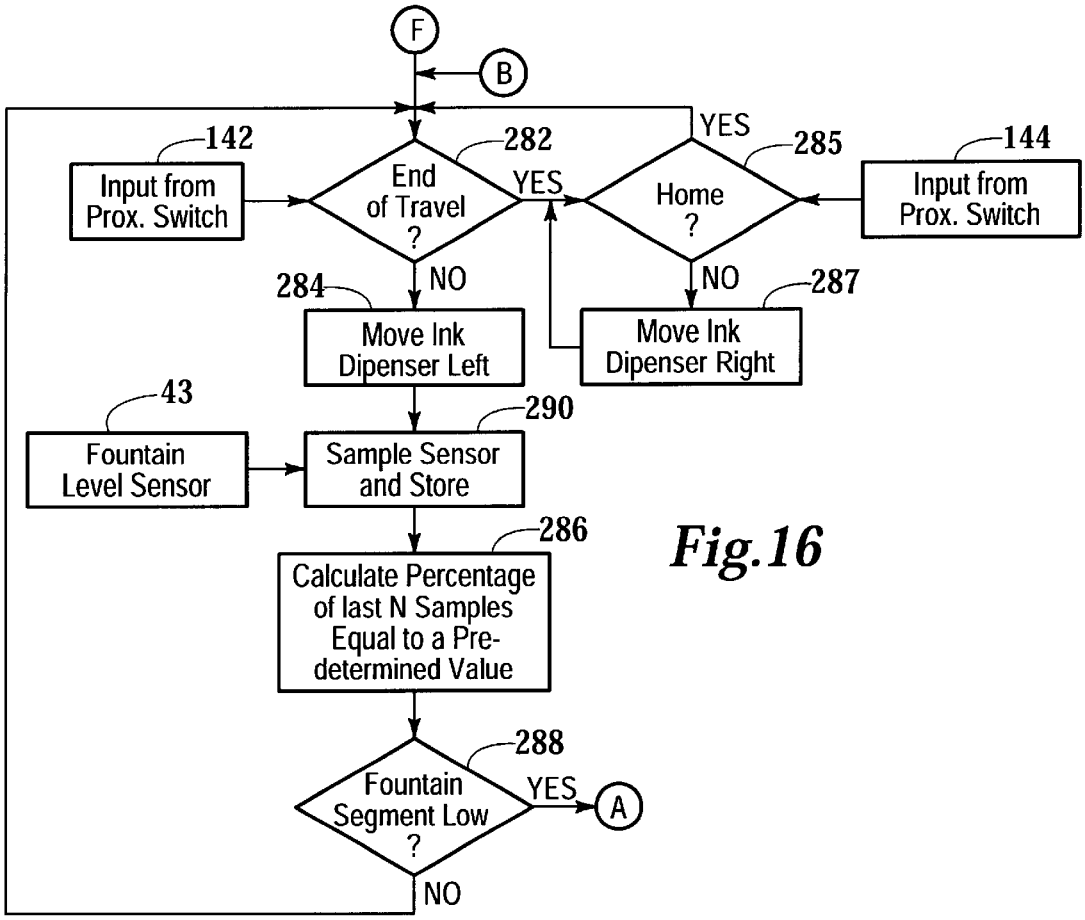
FIG. 16 is a continuation of the flow chart of FIG. 11 illustrating an automatic process of maintaining a predetermined, preferably near minimum, level of ink in the ink fountain.

Referring now to FIG. 16, illustrated is a process for automatically maintaining a predetermined, preferably near minimum, level of ink in the ink fountain 10 (FIGS. 1 and 8). In this "auto" mode, the ink dispenser 26 and ink fountain level sensor 40 (FIGS. 1 and 8) traverses from the home position to the end of travel during which time it automatically dispenses a predetermined amount of ink when a low spot is detected. The level in the ink in the ink fountain is periodically sampled using a photoelectric proximity sensor as shown in FIG. 7 at the ink fountain level sensor. Because the surface of ink in the ink fountain can be uneven, especially if it is viscous or a dry ink such as those used in sheet-fed, lithographic printing, the infrared beam 100 (FIG. 7) emitted by the detector is often reflected in a manner which gives a false reading. For example, it is possible that a surface undulation causes the beam to reflect away from the sensor. If the ink in the fountain at that particular location is, in fact, above a preset level, the detector will fail to detect its presence, thus resulting in a false negative or "low" reading. To filter out the noise of false readings, samples taken across a segment of predefined length are analyzed. As the ink dispenser is moving at a predetermined rate, a predetermined number of samples are taken and stored for the segment. If samples indicate that the ink over the segment is low, ink dispensing is commenced. This indication can be made by determining, in effect, the average or predominant reading. For example, if determining the percentage of the samples over the segment or interval indicate a low ink level, it can be compared to a predetermined percentage or figure of merit. If the percentage of "low" readings exceeds some predetermined value, then dispensing occurs. Although, a series of fixed-length segments may be defined along the length of the ink fountain, it is preferred to utilize a moving window of the last "N" number of samples. This avoids the possibility of low spots developing at boundaries between adjacent segments. A percentage is recalculated for the last N samples is made after each new sample is taken. When the percentage indicates that the ink is low, a predetermined amount of ink is dispensed. By offsetting the ink dispenser so that it trails the photoelectric proximity sensor, ink can be dispensed at a selected point in the ink fountain within the window over which the average was taken, preferably at its beginning.

Turning to decision step 282 of the illustrated flow diagram, so long as the ink dispenser has not reached the end of travel on the linear transport, the ink dispenser 26 and fountain level sensor (FIGS. 1 and 8) are automatically moved in tandem to the left at a predetermined distance, at a predetermined rate, as indicated by step 284. Otherwise, if the ink dispenser is at the end of travel, it and the fountain level sensor are moved home without dispensing ink, as indicated by steps 285 and 287. Once they reach the home position, the process returns to decision step 282.

As the ink dispenser and the fountain level sensor move across the fountain, samples are periodically taken of the sensor. This is indicated by the loop comprised of steps 282, 284, 286, 288 and 290. At step 286 a sample from the fountain level sensor is taken and stored. Using a photoelectric proximity sensor which either indicates the presence or absence of something in its field of view as defined by its infrared beam 100 (FIG. 7), this sample will either be positive or negative: the presence of ink is detected above a preset level (or within a predetermined distance of the sensor), in which case it is positive; or the presence of ink is not detected, in which case it is negative. The value of the sample is stored by the microprocessor 166 (FIG. 10). At step 288, the percentage of either negative or positive readings for the last N number of samples taken on the present traverse is calculated. At the beginning of the traverse, there will be less than N samples available. However, dispensing does not occur before N samples are collected for the reason that the ink dispenser 26 lags the fountain level sensor 28 by at least the distance represented by the N number of samples.

At step 290, a decision is made as to whether the ink level in the ink fountain is too low. This is determined if the calculated percentage of negative readings over the segment or window is greater than a predetermined percentage, or if the percentage positive readings is less than a predetermined percentage. These predetermined percentages are figures of merit determined empirically based on the type of ink used, as well as the ink level which is set, the rate at which the ink dispenser dispense and other factors which may effect the degree of risk that, if ink is not dispensed, ink starvation may occur.

If, at step 290, Ink is to be dispensed, then the process proceeds to step 256 of the ink feed cycle illustrated in FIG. 15 and described above. At step 264 of the ink feed cycle, the process returns to step 282 of FIG. 16 when the ink cartridge is not empty and the ink management system is in "auto" mode.

The forgoing description is of a preferred embodiment of the invention and is intended only to illustrate rather than define the invention. Modifications, substitutions and rearrangements of the forgoing embodiment may be made without departing from the scope of the invention defined by the appended claims and equivalents thereof

What is claimed is:

1. An offset printing press comprising:

an ink train for applying a thin film of ink to a printing plate;

an elongated ink fountain including a fountain roller and a blade for holding a supply of ink, said ink fountain in fluid communication with said ink train; and an ink management system comprising:

a linear support extending across said elongated ink fountain;

a cartridge storing viscous offset printing ink having an exit opening in one end through which ink is dispensed, an open end opposite said exit opening and a movable member disposed within said ink cartridge for displacing ink through the exit opening;

a carriage for releasably holding said cartridge;

means for moving said carriage along said linear support;

means for applying force to said movable member, wherein said means for applying force displaces said movable member thereby dispensing ink through said exit opening;

means for determining the amount of ink dispensed from said cartridge based on a measured displacement of the movable member during a known period in which ink is dispensed from said cartridge.

2. The offset printing press of claim 1 further including a rangefinder for measuring displacement of the movable member.

3. The offset printing press of claim 1, wherein said means for applying force includes a pneumatic head for coupling an open end of said cartridge to form a sealed chamber between said movable member and said pneumatic head, said pneumatic head including an inlet port for introducing compressed air into said sealed chamber to cause said movable member to apply a force to said ink, whereby said ink is dispensed through said outlet.

4. The offset printing press of claim 3 further including a rangefinder mounted within said pneumatic head.

5. The offset printing press of claim 2, wherein said cartridge is removably mountable on said carriage in a predetermined position with respect to said range finder.

6. The offset printing press of claim 4, wherein said range finder is an ultrasonic range finder.

7. The offset printing press claim 1 wherein the means for applying force includes a screw and means for tracking rotation of the screw.

8. An offset printing press comprising:

an ink train for applying a thin film of ink to a printing plate;

an elongated ink fountain for holding a supply of ink, the ink fountain in fluid communication with the ink train; and an ink management system, the ink management system including:

a cartridge storing viscous ink for sheet-fed lithographic printing, the cartridge includes an exit opening in one end through which ink is dispensed, an open end opposite the exit opening and a movable member disposed within the ink cartridge, the movable member moving along a predetermined path under application of force applied through the open end for displacing ink through the exit opening;

a carriage for releasably holding the cartridge;

a linear support extending across the elongated ink fountain, on which the carriage traverses the ink fountain means for determining the movable member's position anywhere along the predefined path within the cartridge; and a computing device in communication with the means for determining the movable member's position and adapted for determining an amount of ink dispensed from the cartridge during a defined period based on displacement of the movable member.

9. The offset printing press of claim 8 wherein the means for determining the movable member's position includes means for measuring displacement of the movable member with respect to a known position.

10. The offset printing press of claim 9 wherein the means for measuring displacement includes an elongated member engaging the movable member.

11. The offset printing press of claim 9, wherein rotation of the elongated member axially displaces the elongated member by an amount dependent on the rotation, and said means for measuring further includes means for knowing how much the elongated member is rotated.

12. The offset printing press of claim 11, wherein the screw is turned by a motor for applying force to move the movable member.

13. The offset printing press of claim 9 wherein the means for measuring displacement includes a range finder aimed through the open end of the cartridge for measuring the distance to the movable member when the movable member is at any position along the predetermined path.

14. The offset printing press of claim 13 wherein the range finder is an ultrasonic range finder.

15. The offset printing press of clam 13, further including a pneumatic actuator for applying pneumatic pressure to the movable member.

16. An offset printing press comprising:

an ink train for applying a thin film of ink to a printing plate;

an elongated ink fountain for holding a supply of ink, the ink fountain in fluid communication with the ink train; and an ink management system, the ink management system including:

a cartridge storing viscous ink for sheet-fed lithographic printing, the cartridge includes an exit opening in one end through which ink is dispensed, an open end opposite the exit opening and a movable member disposed within the ink cartridge, the movable member moving along a predetermined path under application of force applied through the open end for displacing ink through the exit opening;

a carriage for releasably holding the cartridge;

a linear support extending across the elongated ink fountain, on which the carriage traverses the ink fountain;

an actuator for selectively applying force to the movable member;

a range finder aimed through the open end of the cartridge for measuring displacement of the movable member at any position along the predefined path within the cartridge; and a computing device in communication with the range finder and adapted for determining an amount of ink dispensed from the cartridge based on displacement of the movable member.

17. The offset printing press of claim 16, wherein the actuator is selected from the group consisting of electrical, pneumatic and hydraulic actuators.

18. The offset printing press of claim 16, wherein the actuator includes a pneumatic head for coupling an open end of said cartridge to form a sealed chamber between the movable member and the pneumatic head, and wherein the range finder is mounted within the pneumatic head.

19. A method for dispensing ink in an offset printing press, the method comprising:

moving a carriage along a linear support, wherein the linear support extends across an elongated ink fountain and a cartridge of sheet-fed lithographic printing ink is releasably attached to the carriage, whereby movement of the carriage along the linear support enables dispensing of ink from the cartridge along the fountain;

applying force to a movable member disposed in the cartridge, displacement of which along a predetermined path causes ink to be dispersed through an exit opening at one end of the cartridge;

measuring displacement of the movable member, wherein displacement may be measured wherever the movable member is located along the predetermined path within the cartridge;

determining an amount of ink dispensed using the measured displacement of the movable member.

20. The method of claim 19, wherein applying force to the movable member is in response to measurement of ink level in the ink fountain indicating that the ink level is low under the exit opening of the ink cartridge.

21. The method of claim 19 wherein measuring the displacement includes operating a range finder to measure distance from a known position to the movable member.

22. In a lithographic printing press having an ink fountain for holding a supply of lithographic printing ink, and an ink train for delivering a thin film of ink to a printing plate, a method for managing use of ink by the printing press comprising:

traversing a cartridge of viscous lithographic printing ink across the ink fountain, the cartridge including a movable member the displacement of which along a predetermined path results in dispensing of a quantity of ink from the cartridge into the ink fountain, wherein volumetric quantity of ink dispensed is related to displacement of the movable member;

measuring the displacement of the movable member at any location along the predetermined path with a range finder; and determining with a controller in communication with the range finder at amount of ink dispensed during a known period using the displacement of the movable member over the known period.

* * * * *